US012496532B2

(12) United States Patent
Kung et al.

(10) Patent No.: US 12,496,532 B2
(45) Date of Patent: Dec. 16, 2025

(54) REMOVABLE STRUCTURE OF SIMULATED APPEARANCE OF MUZZLE

(71) Applicant: VEGA FORCE INTERNATIONAL CORP., Taoyuan (TW)

(72) Inventors: Shih-Che Kung, Taoyuan (TW); Wei-Hung Chung, Taoyuan (TW)

(73) Assignee: VEGA FORCE INTERNATIONAL CORP., Taoyuan (TW)

( * ) Notice: Subject to any disclaimer, the term of this patent is extended or adjusted under 35 U.S.C. 154(b) by 326 days.

(21) Appl. No.: 18/219,143

(22) Filed: Jul. 7, 2023

(65) Prior Publication Data

US 2024/0350938 A1 Oct. 24, 2024

(30) Foreign Application Priority Data

Apr. 18, 2023 (TW) ..... 112203613

(51) Int. Cl.
*A63H 33/30* (2006.01)
*F41A 21/32* (2006.01)

(52) U.S. Cl.
CPC ..... *A63H 33/30* (2013.01); *F41A 21/325* (2013.01)

(58) Field of Classification Search
CPC ..... F41A 21/325
See application file for complete search history.

(56) References Cited

U.S. PATENT DOCUMENTS

| | | | | |
|---|---|---|---|---|
| 9,513,078 | B1 * | 12/2016 | Fulton | F41A 21/325 |
| 9,739,560 | B1 * | 8/2017 | Salvador | F41A 21/34 |
| 9,791,234 | B2 * | 10/2017 | Palu | F41A 21/325 |
| 9,823,040 | B1 * | 11/2017 | Hu | F41B 11/70 |
| 10,648,757 | B2 * | 5/2020 | Wheeler | F41A 5/26 |
| 10,767,952 | B1 * | 9/2020 | Till | F41A 21/325 |
| 10,801,796 | B2 * | 10/2020 | Kras | F41A 21/325 |
| 11,209,233 | B1 * | 12/2021 | Oglesby | F41A 21/32 |
| 11,874,078 | B2 * | 1/2024 | Roe | F41A 21/325 |
| 12,104,870 | B2 * | 10/2024 | Roe | F41A 21/36 |
| 12,320,605 | B2 * | 6/2025 | Wilson | F41A 21/325 |

* cited by examiner

*Primary Examiner* — Eugene L Kim
*Assistant Examiner* — Alyssa M Hylinski
(74) *Attorney, Agent, or Firm* — HDLS IPR SERVICES; Chun-Ming Shih

(57) ABSTRACT

A removable structure includes a barrel and a simulated structure disposed on the barrel. The simulated structure includes a muzzle, a sleeve base, a removable base, a knob member, an engaging assembly and an elastic fixing assembly. The knob member has a pivoting portion pivoted in the removable base. The pivoting portion has a cam structure. The cam structure has a pressing face and a retracting face. When the pressing face corresponds to the elastic fixing assembly by the pivoting portion rotating in the removable base, the elastic fixing assembly is pressed by the pressing face to be fixed on the barrel. When the retracting face corresponds to the elastic fixing assembly by the pivoting portion rotating in the removable base, the elastic fixing assembly abuts against the retracting face to separate from the barrel.

11 Claims, 8 Drawing Sheets

REMOVABLE STRUCTURE OF SIMULATED APPEARANCE OF MUZZLE

BACKGROUND

Technical Field

The disclosure relates to a toy gun, particularly to a removable structure of simulated appearance of muzzle.

Related Art

Most toy guns imitate the appearance of real firearms as one of their selling features. However, because of different internal action principles such as firing, the imitative appearance is primarily based on the outline, so that their components are usually designed to be not separable or removable. Thus, they fail to have a removable design.

However, such as design is not only easy to be different from a real firearm, but also possible to affect the internal components of a toy gun itself, for example, the convenience in removal and change.

In view of this, the inventors have devoted themselves to the above-mentioned prior art, researched intensively and cooperated with the application of science to try to solve the above-mentioned problems. Finally, the invention which is reasonable and effective to overcome the above drawbacks is provided.

SUMMARY

An object of the disclosure is to provide a removable structure of simulated appearance of muzzle, which implements a removable design to a simulated structure on a muzzle of a toy gun to make the simulated structure removable so as to make the internal components (such as a battery or a battery pack of an electric gun) changeable.

To accomplish the above object, the disclosure provides a removable structure of simulated appearance of muzzle, which includes a barrel and a simulated structure disposed on the barrel. The simulated structure includes a muzzle, a sleeve base disposed on the muzzle, a removable base disposed on the sleeve base, a knob member using a pivoting portion to be pivoted in the removable base, an engaging assembly using a pressing rod to be elastically disposed on the sleeve base and an elastic fixing assembly disposed in the sleeve base. The muzzle and the sleeve base jointly have a passing hole for being inserted by the barrel. The knob member is disposed with an engaging portion which is locally radially extended. A pressing rod of the engaging assembly is disposed with an engaging block making restraint to the engaging portion. The pivoting portion of the knob member further has a cam structure in the removable base. The cam structure has a pressing face and a retracting face. The elastic fixing assembly can be elastically shifted between the passing hole and the removable base. The pressing face corresponds to the elastic fixing assembly by the pivoting portion rotating in the removable base. The elastic fixing assembly is pressed by the pressing face to be elastically shifted toward the passing hole and to be fixed on the barrel. The retracting face corresponds to the elastic fixing assembly by the pivoting portion rotating in the removable base. The elastic fixing assembly abuts against the retracting face to be elastically shifted toward the pivot hole and to separate from the barrel.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
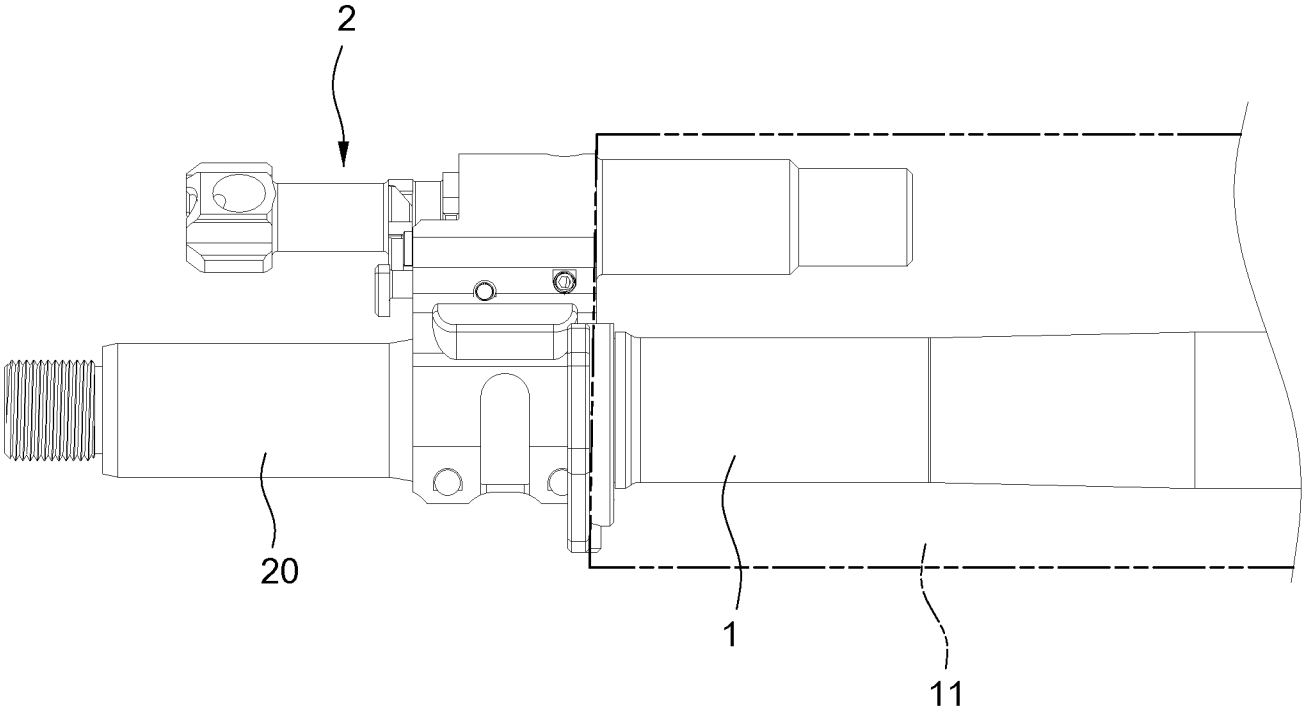
FIG. 1 is a planar schematic view of the disclosure.
Figure 2:
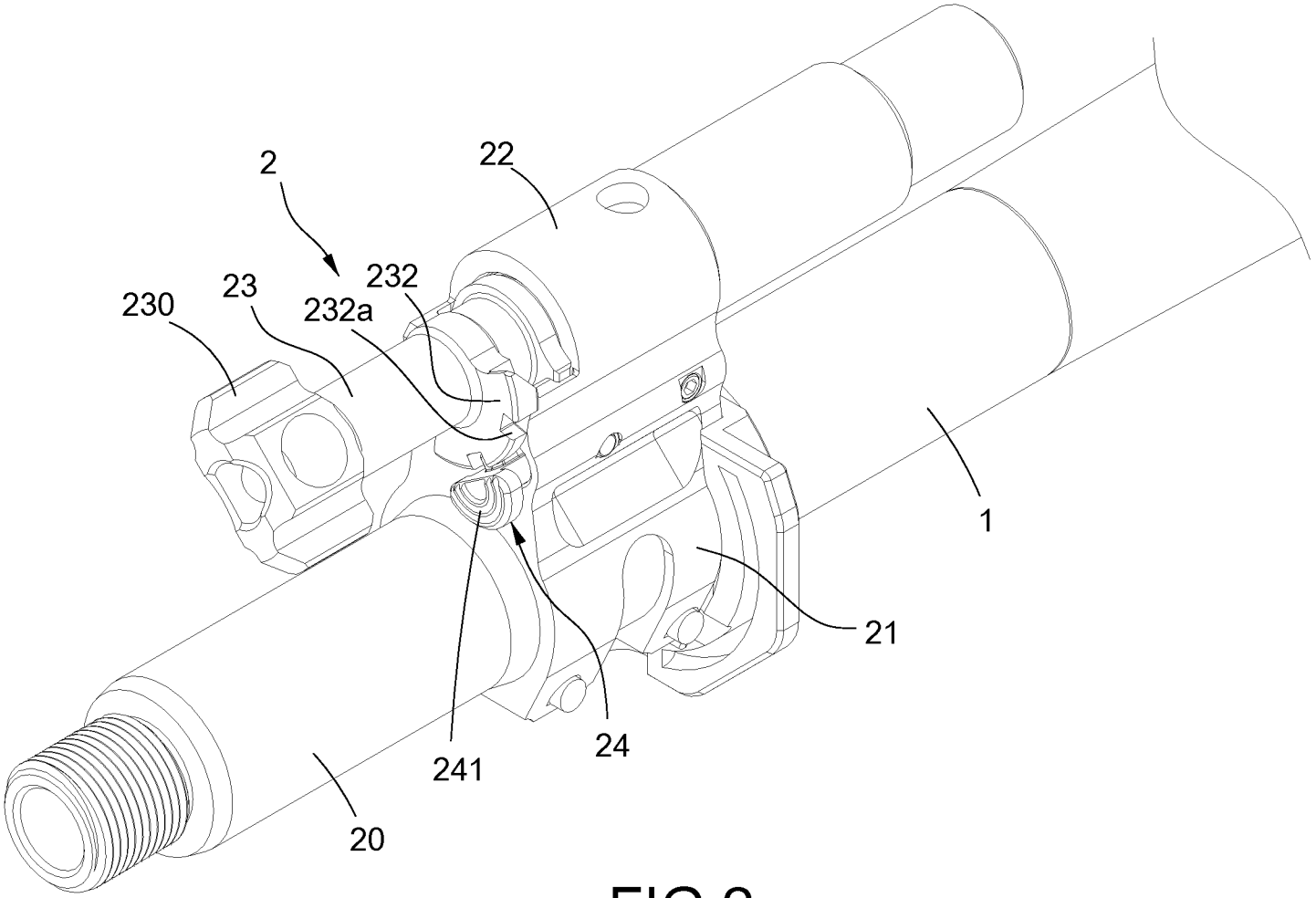
FIG. 2 is a perspective assembled view of the disclosure.
Figure 3:
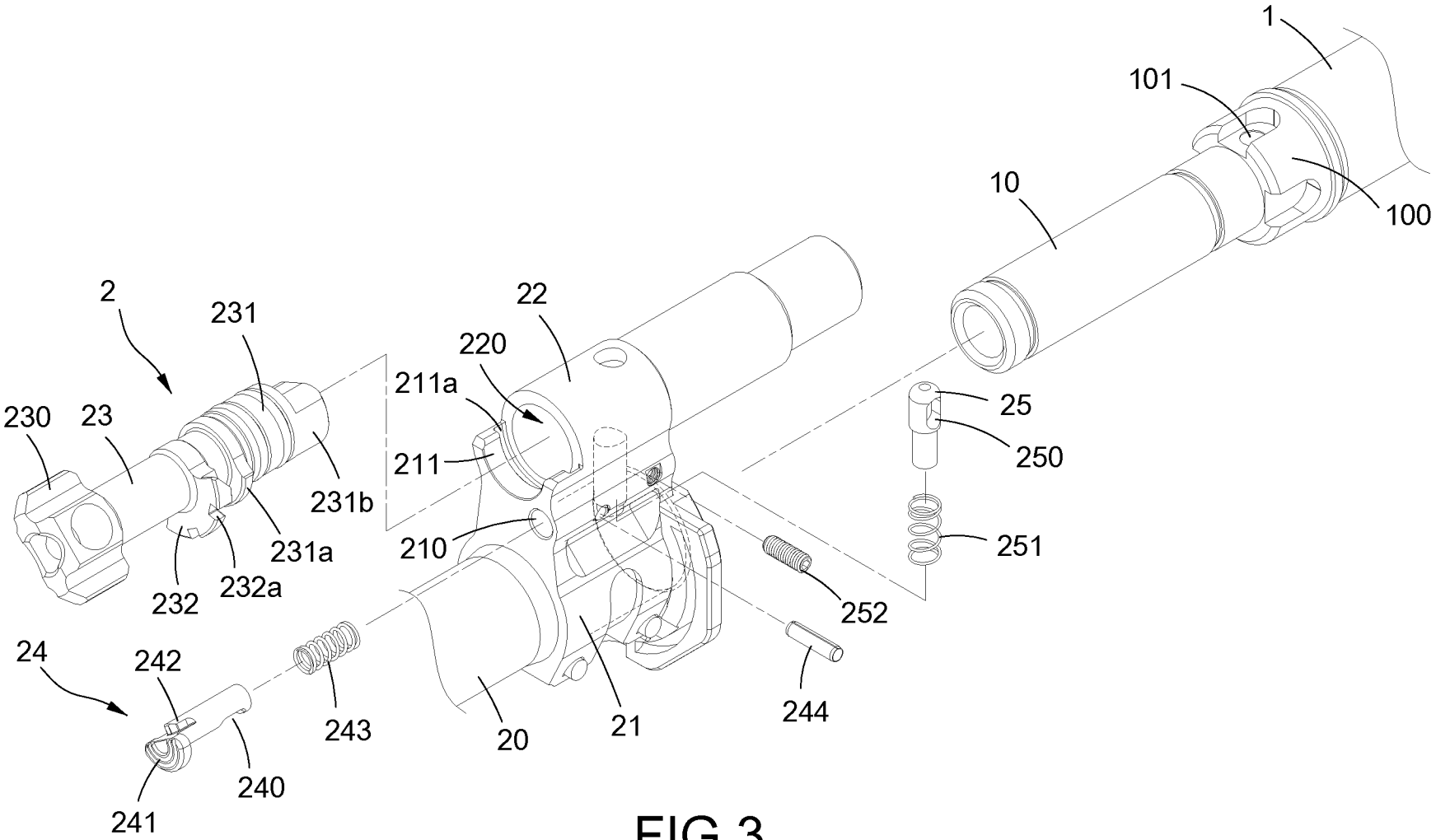
FIG. 3 is an exploded view of the disclosure.

Please refer to FIGS. 1-3, which are a planar schematic view, a perspective assembled view and an exploded view of the disclosure. The disclosure provides a removable structure of simulated appearance of muzzle, which includes a barrel 1 and a simulated structure 2 disposed on the barrel 1.

The barrel 1 may be a barrel of various toy guns and may be associated with a gun body of various firearms to imitate the appearance of a real firearm. The barrel 1 has a front end portion 10 to be connected with the simulated structure 2. The barrel 1 may be provided with a handguard 11. Components or mechanisms, such as a battery or a battery pack of an electric gun (not shown), required by a toy gun may be disposed in the handguard. Also, by the removable manner according to the simulated structure 2, the toy gun components disposed in the handguard 11 may be changed under the condition of not removing the handguard 11 so as to have both the appearance of toy simulated gun and the convenience in changing components.

The simulated structure 2 is disposed on the front end portion 10 of the barrel 1. Its outline may imitate the appearance of the muzzle portion of the front end of the barrel of a real gun. The simulated structure 2 includes a muzzle 20, a sleeve base 21 located at a rear end of the muzzle 20, a removable base 22 disposed on the sleeve base 21, a knob member 23 connected to the removable base 22, an engaging assembly 24 and an elastic fixing assembly 25. Please further refer to FIGS. 4-5. The muzzle 20 has a passing hole 200 penetrating through the rear end of the muzzle 20. The muzzle 20 may be integrated with the sleeve base 21 and the removable base 22 to be one piece or only both the sleeve base 21 and the removable base 22 are integrated into one piece first and then the sleeve base 21 is sheathed on the rear end of the muzzle 20. The sleeve base 21 uses a passing hole 200 of the muzzle 20 to be inserted by the front end of the barrel 10. Because the outline of the barrel 10 is circular usually, an embedding portion 100 may be disposed on the barrel 10 to be embedded in the passing hole 200 for positioning to prevent the simulated structure 2 from rotating on the barrel 10.

Accordingly, the removable base 2 has a pivot hole 220 which may be toward the same direction as the front end of the muzzle 20 to allow the knob member 23 to be pivoted on the pivot hole 200. A side of the sleeve base 21, which is toward the muzzle 20, is disposed with a positioning hole 210 for receiving the engaging assembly 24 and engaging the knob member 23. The knob member 23 may be a rod-shaped element whose one end has a handle knob 230 for being rotated by a hand and the other end has a pivoting portion 231 pivoted in the pivot hole 220. The knob member 23 is disposed with an engaging portion 232 which is locally radially extended. The engaging portion 232 is formed with at least one engaging edge 232*a*. The engaging assembly 24 has a pressing rod 240. The pressing rod 240 is disposed with a pressing button 241 and an engaging block 242 toward the engaging portion 232. The engaging block 242 is engaged in the engaging edge 232*a* of the engaging portion 232 depending upon the rotation position or direction of the knob member 23 for restraining the knob member 23 to rotate. The pressing rod 240 may use an elastic element 243 to be elastically disposed in the positioning hole 210 of the sleeve base 21 and to make the pressing button 241 and the engaging block 242 exposed from the positioning hole 210.

Figure 5:
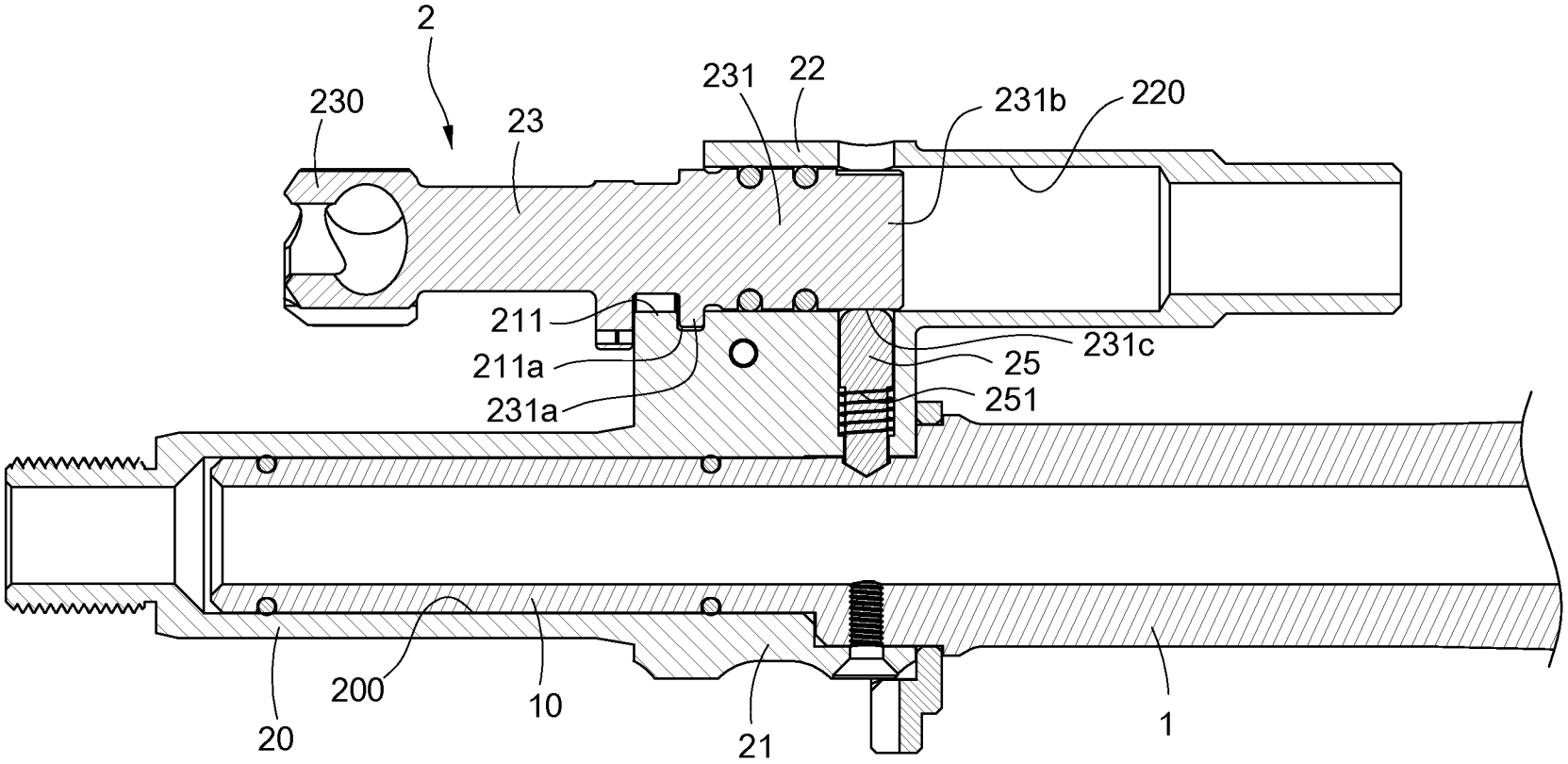
FIG. 5 is a cross-sectional view according to 5-5 of FIG. 4.
Figure 7:
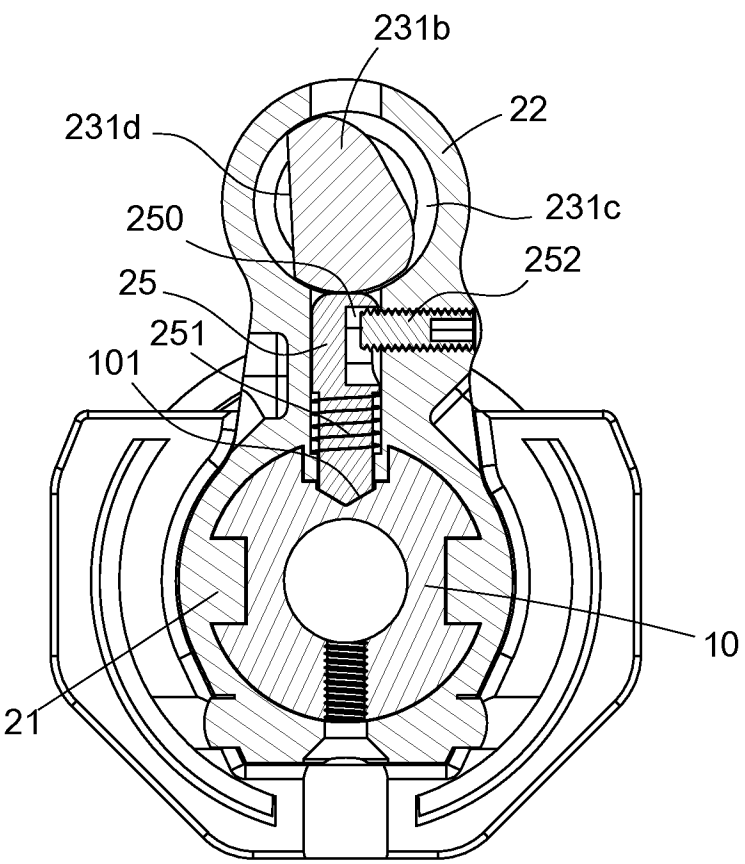
FIG. 7 is a cross-sectional view according to 7-7 of FIG. 4.
Figure 10:
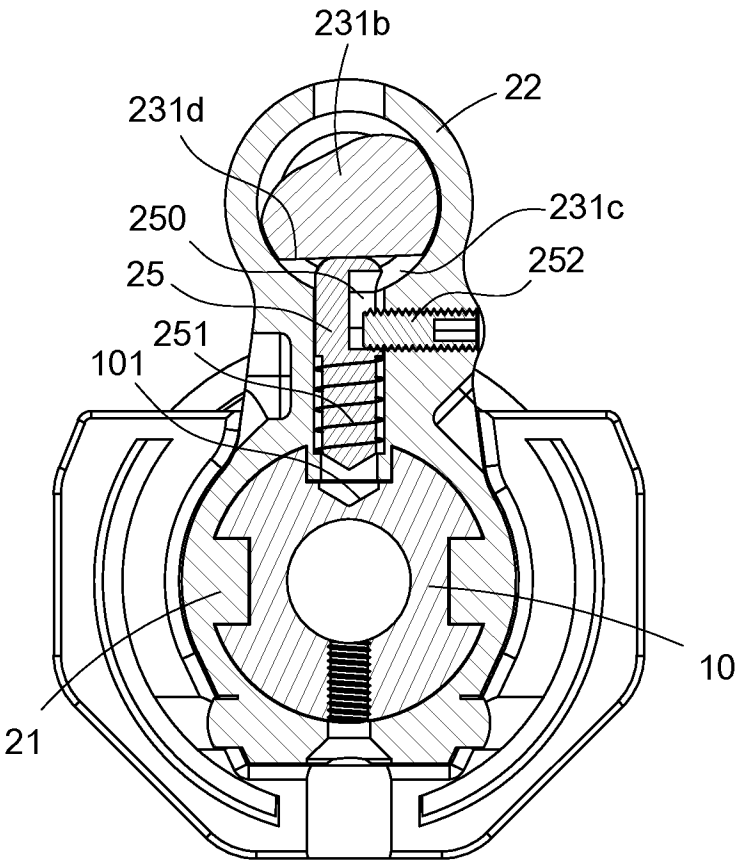
FIG. 10 is a schematic view of the operation according to FIG. 7.

Furthermore, the sleeve base 21 may be formed with an arcuate trough 211 on the front end of the pivot hole 220 of the muzzle 20. The arcuate trough 211 is disposed with an indented edge 211*a*. The knob member 23 is disposed with a protrudent arcuate portion 231*a* which is locally radially extended. When the knob member 23 uses the pivoting portion 231 to be pivoted in the pivot hole 220, the protrudent arcuate portion 231*a* corresponds to the inside of the indented edge 211*a* to prevent the knob member 23 from falling off or falling out from the pivot hole 220. In addition, the pivoting portion 231 further has a cam structure 231*b* in the pivot hole 220. The cam structure 231*b* corresponds to the elastic fixing assembly 25 disposed in the sleeve base 21 (as shown in FIG. 5). The elastic fixing assembly 25 may be disposed with a restraint trough 250 and may be pushed by an elastic element 251 to locally project into the pivot hole 220 (as shown in FIG. 10) or is pressed by the cam structure 231*b* to locally stretch into the passing hole 200 (as shown in FIG. 7), then a restraint member 252 stretches into the restraint trough 250 from the outside of the sleeve base 21 for restraint to make the elastic fixing assembly 25 limitedly shifted between the passing hole 200 and the pivot hole 220.

Thus, by the above structure, the removable structure of simulated appearance of muzzle may be obtained.

Figure 4:
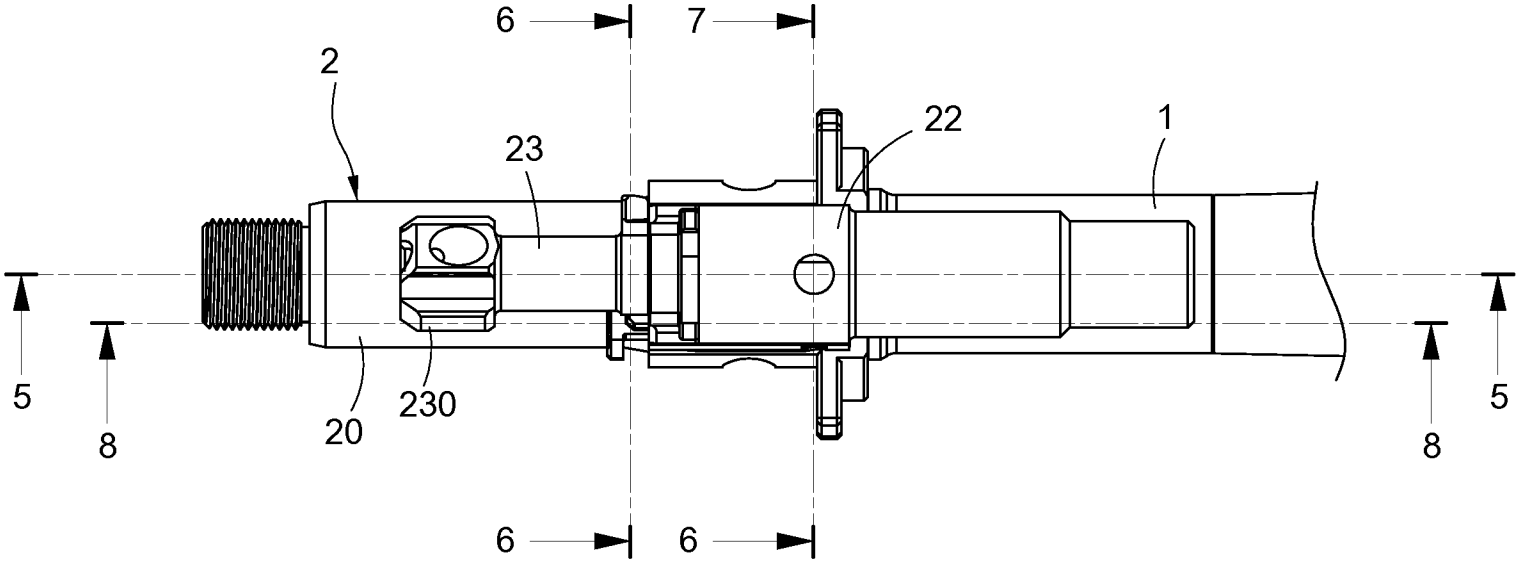
FIG. 4 is a top view of the disclosure.
Figure 6:
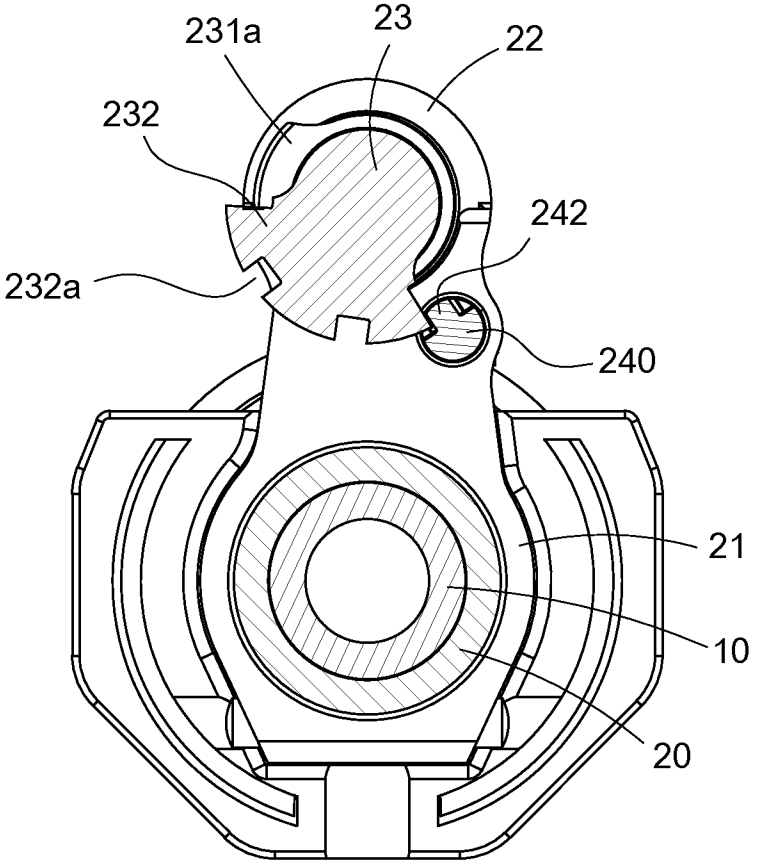
FIG. 6 is a cross-sectional view according to 6-6 of FIG. 4.

Accordingly, as shown in FIGS. 4-6, when the simulated structure 2 is fixed on the barrel 10, it may use a side of the engaging portion 232, which is adjacent to the pressing rod 240, or the engaging edge 232*a* on the engaging portion 232 to abut against the engaging block 240 of the engaging assembly 24 so as to make the knob member 23 unable to rotate on the sleeve base 21. As shown in FIG. 7, at this time, the cam structure 231*b* has a pressing face 231*c* pressing the elastic fixing assembly 25 toward the passing hole 200 to fix the elastic fixing assembly 25 to the barrel 25. In detail, the barrel 10 may be disposed with a fixing hole 101 (refer to FIG. 1). In some embodiments, the fixing hole 101 may be disposed in a recess area of the embedding portion 100 to make a distal end of the elastic fixing assembly 25 fixed in the fixing hole 101 such that the simulated structure 2 cannot separate from the barrel 10 for assembling.

Figure 8:
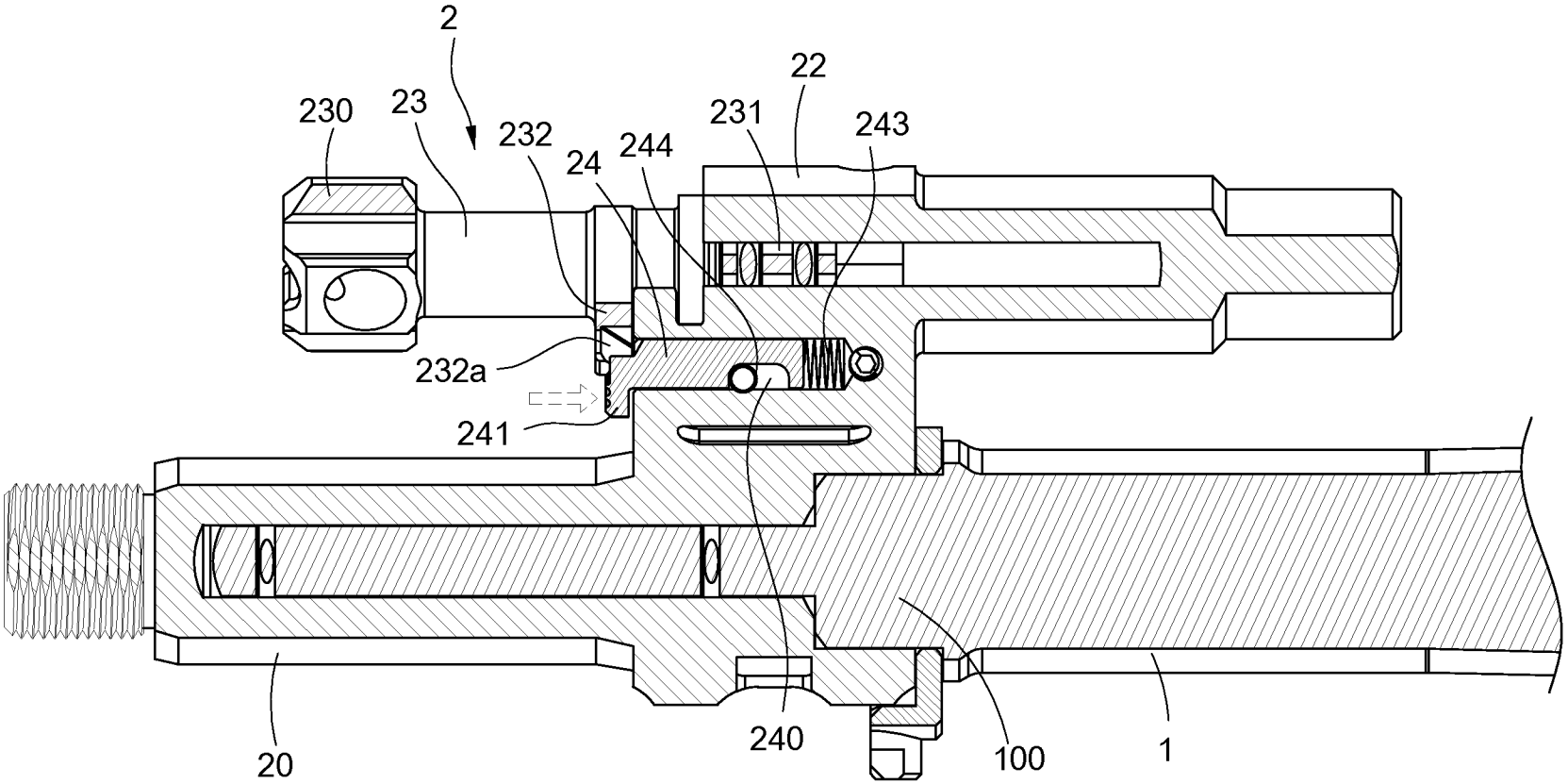
FIG. 8 is a cross-sectional view according to 8-8 of FIG. 4.
Figure 9:
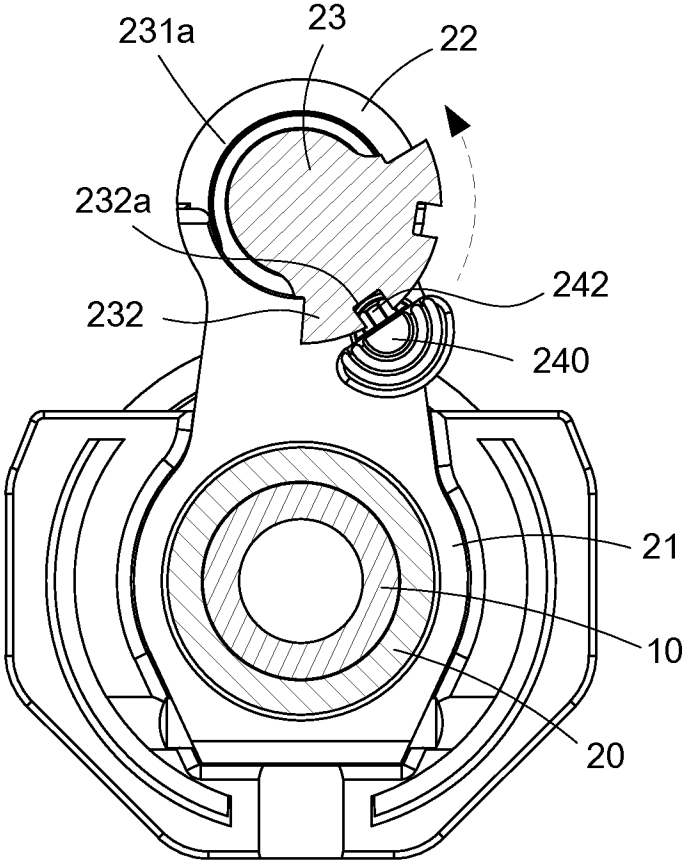
FIG. 9 is a schematic view of the operation according to FIG. 6.

Please refer to FIGS. 4, 8 and 9. When the simulated structure 2 is removed from the barrel 10, a user only needs to press the pressing button 241 of the engaging assembly to make the pressing rod 240 with the engaging block 242 retract in the positioning hole 210 to rotate the knob member 24 on the sleeve base 21. As shown in FIG. 10, because the cam structure 231*b* also rotates with it and the cam structure 231*b* has a retracting face 231*d* toward the elastic fixing assembly 25 due to rotation, the elastic fixing assembly 25 abuts against the retracting face 231*d* by the elasticity of the elastic element 251 and the distal end of the elastic fixing assembly 25 exits the fixing hole 101. Thus, the simulated structure 2 may be separated from the barrel 10 for removal. It is noted that as shown in FIG. 8, the engaging assembly 25 may also use a restraint member 244 to restrain its movable range in the positioning hole 210.

While this disclosure has been described by means of specific embodiments, numerous modifications and variations could be made thereto by those skilled in the art without departing from the scope and spirit of this disclosure set forth in the claims.

What is claimed is:

1. A removable structure having a simulated appearance of a muzzle, comprising a barrel and a simulated structure disposed on the barrel, the simulated structure comprising:
   - a muzzle;
   - a sleeve base, disposed on the muzzle, and the muzzle and the sleeve base jointly comprising a passing hole that receives the barrel;
   - a removable base, disposed on the sleeve base, and comprising a pivot hole;
   - a knob member, comprising a pivoting portion rotatable in the pivot hole and an arc-shaped engaging portion which extends radially from the knob member, the pivoting portion comprising a cam structure in the pivot hole, and the cam structure comprising a pressing face and a retracting face;
   - an engaging assembly, comprising a pressing rod elastically disposed on the sleeve base, the pressing rod being disposed with an engaging block for restraining rotation of the engaging portion; and
   - an elastic fixing assembly, disposed in the sleeve base and configured for elastically shifted between a passing hole position and a pivot hole position;
   - wherein when the pivoting portion rotates in the pivot hole and places the pressing face in contact with the elastic fixing assembly, the elastic fixing assembly is elastically shifted toward the passing hole position and is fixed on the barrel positioned in the passing hole; and when the pivoting portion rotates in the pivot hole and places the retracting face in contact with the elastic fixing assembly, the elastic fixing assembly is elastically shifted toward the pivot hole position and is separated from the barrel positioned in the passing hole.

2. The removable structure of claim 1, wherein the barrel comprises a front end portion inserted in the passing hole.

3. The removable structure of claim 1, wherein the barrel is disposed with a fixing hole positioned in communication with a distal end of the elastic fixing assembly.

4. The removable structure of claim 3, wherein the barrel is disposed with an embedding portion inserted in the passing hole for positioning.

5. The removable structure of claim 1, wherein the barrel is disposed with an embedding portion inserted in the passing hole for positioning.

6. The removable structure of claim 1, wherein the sleeve base and the removable base are integrated into one piece.

7. The removable structure of claim 6, wherein the barrel, the sleeve base and the removable base are further integrated into one piece.

8. The removable structure of claim 1, wherein the sleeve base is disposed with an arcuate trough on a front end of the pivot hole of the muzzle, the arcuate trough is disposed with an indented edge, the knob member further comprises a radially extending arcuate portion, when the pivoting portion of the knob member is rotated in the pivot hole, the arcuate portion is positioned in communication with an inside of the indented edge.

9. The removable structure of claim 1, wherein the knob member is a rod-shaped element, one end of the knob member comprises a handle knob, and the pivoting portion is located at another end of the knob member.

10. The removable structure of claim 1, wherein the engaging portion is formed with at least one engaging edge positioned in communication with the engaging block.

11. The removable structure of claim 1, wherein the pressing rod is disposed with a pressing button, and the pressing button and the engaging block are exposed from the sleeve base.

* * * * *